US005559523A

United States Patent [19]

Smith et al.

[11] Patent Number: 5,559,523

[45] Date of Patent: Sep. 24, 1996

[54] LAYERED ANTENNA

[75] Inventors: Martin S. Smith; Dean Kitchener, both of Chelmsford, United Kingdom

[73] Assignee: Northern Telecom Limited, Quebec, Canada

[21] Appl. No.: 358,735

[22] Filed: Dec. 19, 1994

Related U.S. Application Data

[63] Continuation-in-part of Ser. No. 969,750, Oct. 30, 1992, abandoned.

[30] Foreign Application Priority Data

Nov. 15, 1991 [GB] United Kingdom ..... 9124291.7

[51] Int. Cl.[6] ..... H01Q 21/12

[52] U.S. Cl. ..... 343/795; 343/815; 343/818

[58] Field of Search ..... 343/795, 778, 343/797, 810, 812, 813, 815, 817, 818, 834; H01Q 21/12, 21/20, 21/24, 21/26

[56] References Cited

U.S. PATENT DOCUMENTS 4,614,947 9/1986 Rammos ..... 343/778
4,827,276 5/1989 Fukuzawa et al. ..... 343/778

*Primary Examiner*—Michael C. Wimer
*Attorney, Agent, or Firm*—Lee, Mann, Smith, McWilliams, Sweeney & Ohlson

[57] ABSTRACT

A layered antenna is disclosed having at least one radiating element comprising a pair of colinear probes together forming a dipole and a distribution network therefor formed as a single printed conductive pattern layer, a separate metallic layer spaced at a uniform distance from said conductive pattern layer, the metallic layer acting as a ground plane for the distribution network only and further shaped to form a pair of substantially identical parasitic radiating elements for the probes of each radiating element dipole.

20 Claims, 3 Drawing Sheets

LAYERED ANTENNA

RELATED APPLICATIONS

This application is a continuation-in-part of U.S. Ser. No. 969,750 filed on Oct. 30, 1992 now abandoned.

BACKGROUND OF THE INVENTION

This invention relates to layered antennas having either directional or omnidirectional field patterns in azimuth with limited elevation radiation patterns.

Conventional dipole antennas in which a pair of colinear quarter wavelength radiators are fed in anti-phase will produce a substantially omni-directional radiation pattern in a plane normal to the axis of the radiators. If the radiators are placed parallel to and a quarter of a wavelength from a reflecting ground plane the radiation pattern becomes substantially directional. If several radiators are layered vertically, the radiation pattern is substantially in azimuth and restricted in elevation. An important factor in the design of an antenna is the gain of the antenna. Provision of a reflector will increase the gain in front of the antenna while reducing the gain behind. For modern telecommunications application at high frequencies, e.g. above 100 MHz, apart from the electrical performance of the antenna other factors need to be taken into account, such as size, weight, cost and ease of construction of the antenna. Depending on the requirements an antenna can be either a single radiating element (e.g. one dipole) or an array of like radiating elements.

SUMMARY OF THE INVENTION

According to the invention there is provided a layered antenna having at least one radiating element comprising a pair of colinear probes together forming a dipole and a distribution network therefor formed as a single printed conductive pattern layer, a separate metallic layer spaced at a uniform distance from said conductive pattern layer, the metallic layer acting as a ground plane for the distribution network only and further shaped to form a pair of substantially identical parasitic radiating elements for the probes of each radiating element dipole.

According to one embodiment of the invention there is provided a layered antenna having at least one radiating element comprising: a metallic ground plane having a pair of identical rectangular apertures in alignment; a pair of colinear probes each projecting in opposite direction into a respective aperture to form a dipole, and; a feed network conductor pattern connected to and arranged to feed the probes in antiphase whereby each probe radiates through its respective aperture; wherein the probes are continuations of the feed network conductor pattern, the feed network conductor pattern and the probes are formed on an insulating substrate adjacent to and spaced at a uniform distance to the ground plane, and; wherein the dimensions of the apertures in relation to the overall dimensions of the ground plane are such that the edges of the portions of the ground plane defining the edges of the apertures parallel to the probes act as parasitic radiating elements and the feed network conductor pattern is positioned so as to be in alignment with unapertured portions of the ground plane in a microstrip configuration. In a further embodiment, the antenna includes a second ground plane having the same arrangement of apertures as the first ground plane, wherein the first ground plane, the feed network and the second ground plane together form a triplate structure.

In a further embodiment of the antenna a plurality of like radiating elements are formed in alignment in a common ground plane with a common feed network conductor pattern arranged to feed all the probes having one orientation in phase and all the probes having an opposing orientation in antiphase.

The antenna may further include a reflector plane spaced from the rear of the antenna. The ground planes may be formed as a stamped aluminium sheet. The feed network and the probes can be formed as a printed circuit pattern on an insulating substrate. The feed network can be separated from a ground plane by means of a foamed dielectric sheet.

BRIEF DESCRIPTION OF THE DRAWINGS

Embodiments of the invention will now be described with reference to the accompanying drawings, in which.

DESCRIPTION OF THE PREFERRED EMBODIMENTS

Figure 1:
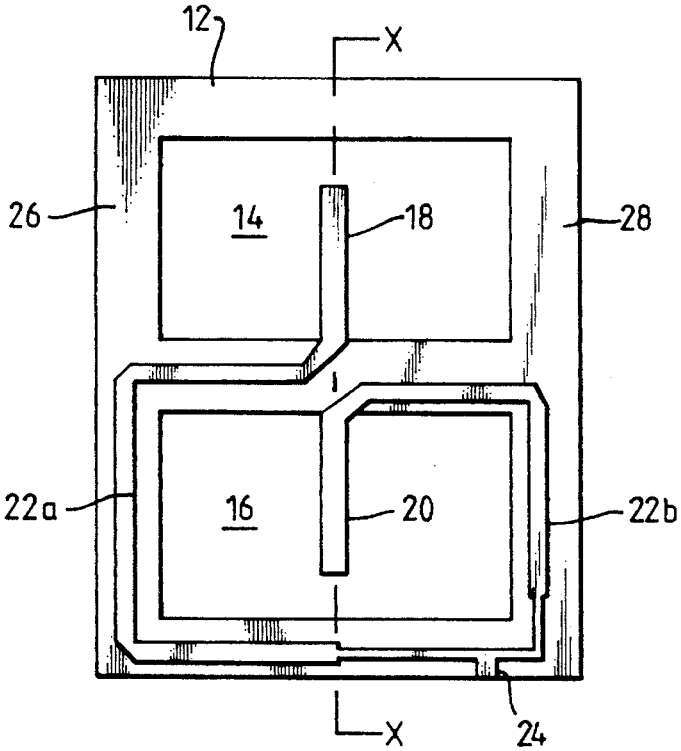
FIG. 1 illustrates a layered antenna having a dipole pair with a feed network formed in microstrip.
Figure 2:
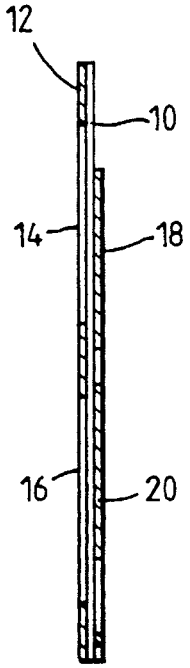
FIG. 2 is a schematic side view of the antenna of FIG. 1 on the section line 2—2 of FIG. 1.

The layered antenna element shown in FIGS. 1 and 2 comprises an insulating substrate 10 to one side of which is positioned a metallic ground plane 12 having a pair of identical rectangular apertures 14, 16. On the opposite side of the substrate there is positioned a metallic conductor pattern which consists of a pair of radiating probes 18, 20 and a common feed network 22*a* , 22*b* . A feed point 24 is provided for connection to an external feed (not shown). The feed network 22*a* , 22*b* is positioned so as to form a microstrip transmission line with portions of the ground plane defining the rectangular apertures. The position of the feed point 24 is chosen so that when an r.f. signal of a given frequency is fed to the network the relative lengths of the two portions 22*a* and 22*b* of the network are such as to cause the pair of probes 18 and 20 to be fed in antiphase, thereby creating a dipole antenna radiating element structure. Furthermore, the dimensions of the rectangular apertures and the bounding portions of the ground plane are chosen so that the bounding portions 26, 28 parallel with the probes 18, 20 act as parasitic antenna radiating elements, which together with the pair of radiating probes 18, 20 shape the radiation pattern of the antenna.

Figure 3:
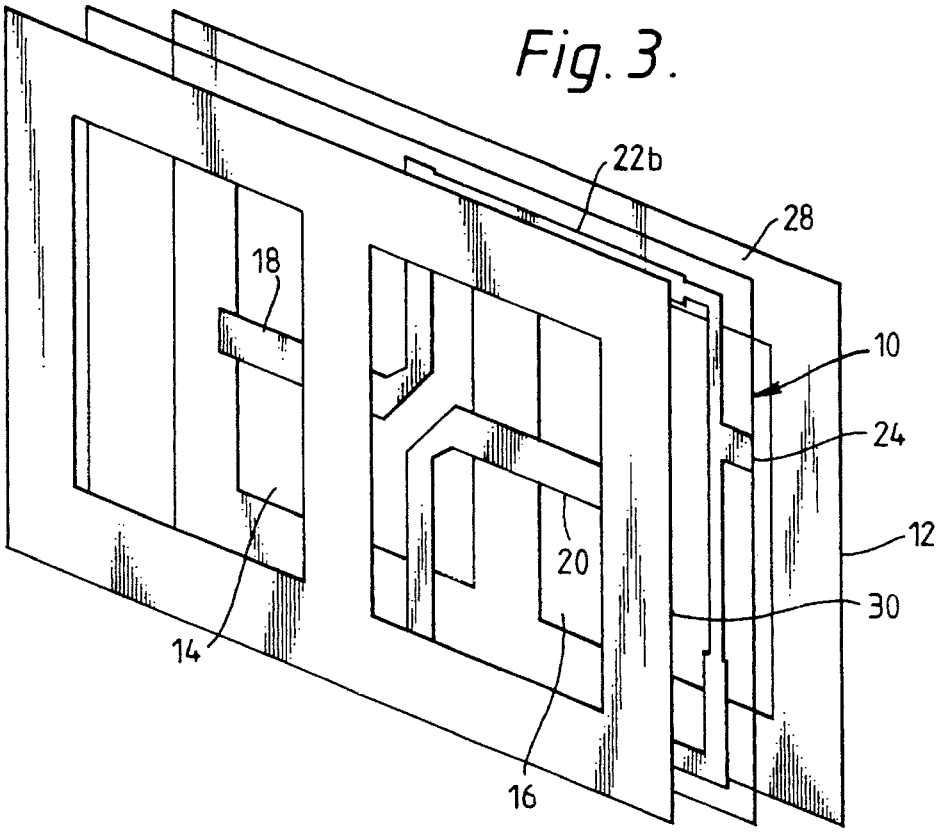
FIG. 3 is an exploded perspective view of a triplate version of the single element antenna of FIGS. 1 and 2.

FIG. 3 shows a triplate version of the antenna of FIGS. 1 and 2 in which a second ground plane 30 identical with ground plane 12 is placed on the other side of the substrate 10. The second ground plane is spaced from the plane of the feed network by dielectric spacing means (not shown) so that the feed network is equally spaced from both ground planes. In practice the feed network can be formed by conventional printed circuit techniques on a fibre glass board and the ground planes can be stamped out of aluminium sheets. Spacing between the network and the ground planes can be determined by foamed dielectric sheets or dielectric studs interposed between the various layers. To provide a degree of directionality for the antenna a metallic back reflector 32 can be attached to the antenna as shown in FIG. 4.

Figure 5A:
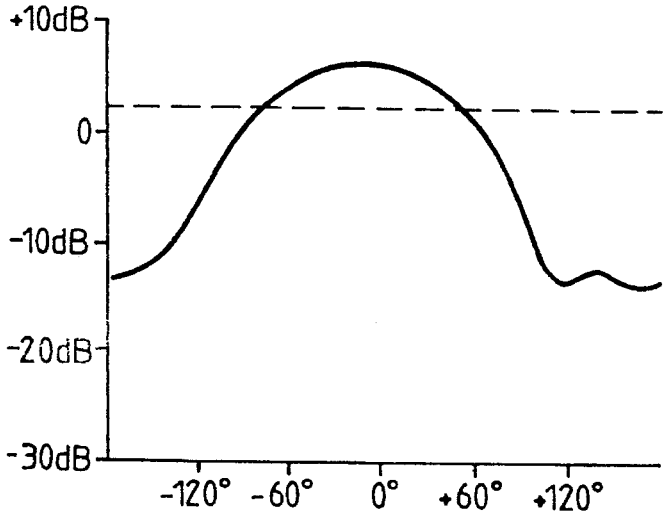
FIG. 5*a* and FIG. 5*b* show the measured azimuth radiation pattern for an antenna constructed in (a) microstrip and (b) triplate, both with a back reflector.

An experimental single element antenna was constructed as shown in FIGS. 1 and 2 using a fibre glass substrate board 10 of 1.6 mm thickness on which the feed network 22*a*, 22*b* and radiating probes 18, 20 were formed as printed circuitry. The overall antenna width was 80 mm and length was 115 mm. Each aperture was 40 mm by 60 mm. Each probe was 26.5 mm long. The feed network was in general 5 mm wide but parts of it were only 3 mm wide to achieve suitable impedance matching. A reflector 32, 40 mm wide by 115 mm long, was spaced 40 mm from the radiating element. FIG. 5*a* shows the measured azimuth radiation pattern for this antenna at a frequency of 1795 MHz. It will be noted that a beamwidth of approximately 120° is obtained with a peak gain of 6 dBi.

Figure 4:
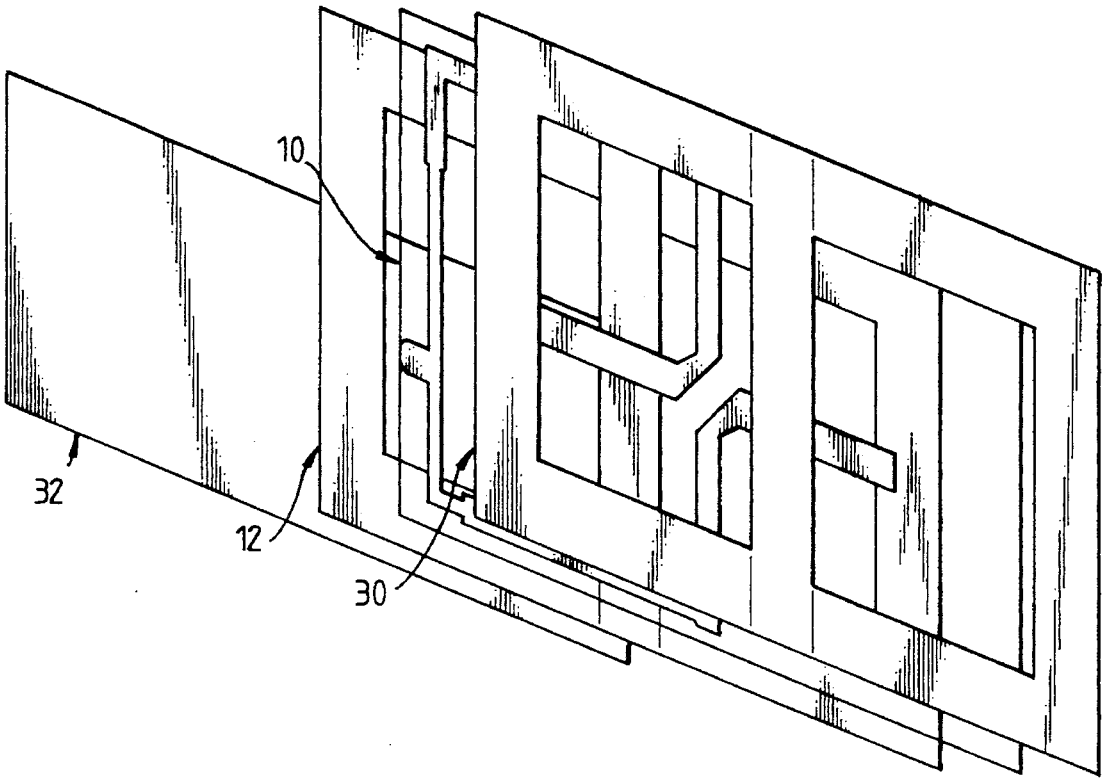
FIG. 4 is an exploded perspective view of a triplate single element antenna with a back reflector.
Figure 5B:
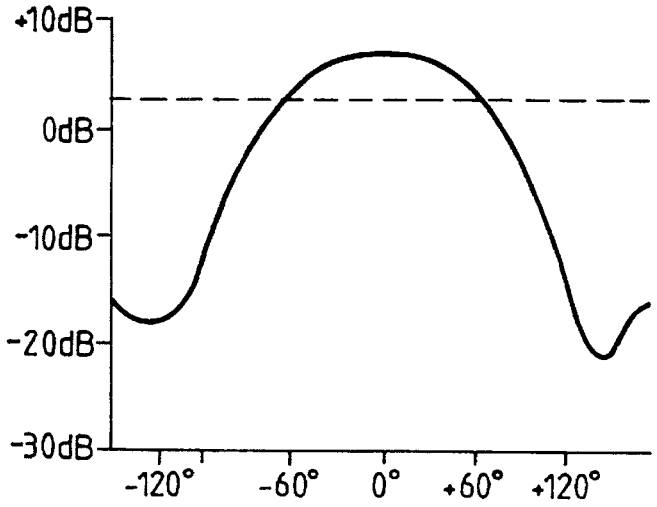

A second single element triplate antenna was constructed as shown in FIG. 4 but with a modified feed network. The wide portions of the feed network were 3.5 mm and the narrow portions were 2 mm wide. The overall dimensions were still 80 mm by 115 mm and the dimensions of the apertures were again 40 mm by 60 mm. The back reflector of 40 mm width was retained at a spacing of 40 mm but the ground plane spacing was changed to 2.4 mm and the effective dielectric constant for the structure was equal to unity. The azimuth radiation pattern at 1795 MHz is shown in FIG. 5*b*.

Figure 6:
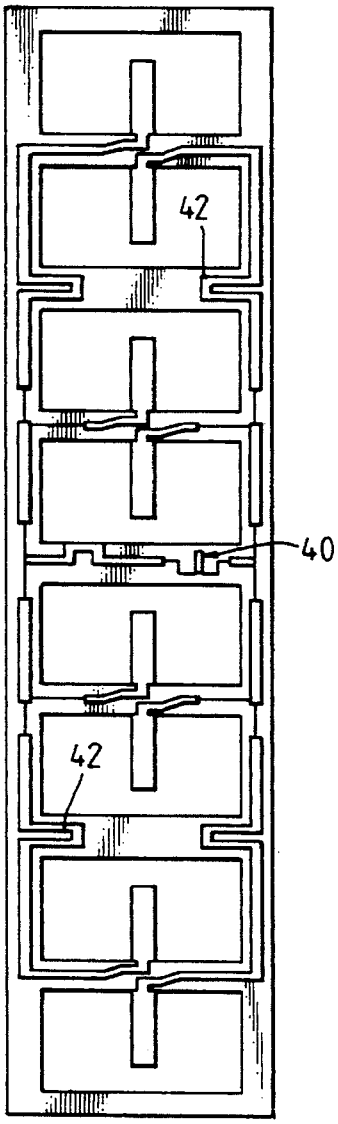
FIG. 6 illustrates a four element microstrip antenna array.

Finally a four element microstrip array was built using element apertures 40 mm by 60 mm as shown in FIG. 6. A modified feed network having a central feed point 40 incorporated additional lengths of printed circuit track 42 to provide the necessary phase adjustments for the individual probe feeds. All the probes having one orientation are fed in phase by the network down one side of the array and all the probes having opposite orientation are fed in antiphase by the network on the other side of the array.

The element spacing was 115 mm (0.69λ at 1795 MHz) and a back reflector was attached as before. The array has a 3 dB azimuth beamwidth of approximately 120°, a good front-to-back ratio and a low cross-polar level.

We claim:

1. A layered antenna having at least one radiating element comprising:

a metallic ground plane having a pair of identical rectangular apertures in alignment;

a pair of colinear probes each projecting in opposite direction into a respective aperture to form a dipole, and;

a feed network conductor pattern connected to and arranged to feed the probes in antiphase whereby each probe radiates through its respective aperture;

wherein the probes are continuations of the feed network conductor pattern, the feed network conductor pattern and the probes are formed on an insulating substrate adjacent to and spaced at a uniform distance to the ground plane;

wherein the dimensions of the apertures and the bounding portions of the ground plane are chosen so that the bounding portions parallel with the probes act as parasitic antenna radiating elements, which together with the pair of radiating probes shape the radiation pattern of the antenna; and wherein the feed network conductor pattern is positioned so as to be in alignment with unapertured portions of the ground plane in a microstrip configuration.

2. A layered antenna according to claim 1, having a plurality of radiating elements each according to claim 1, formed as a linear array, the pairs of probes of all the radiating elements being in alignment, the antenna having a feed network conductor pattern arranged to feed all the probes having one orientation in phase and all the probes having an opposing orientation in antiphase.

3. A layered antenna according to claim 1, including a reflector plane spaced from the rear of the antenna.

4. A layered antenna according to claim 1 wherein the ground plane is formed as a stamped aluminium sheet.

5. A layered antenna according to claim 1, wherein the feed network and the probes are formed as a printed circuit pattern on said insulating substrate.

6. A layered antenna according to claim 1, wherein there is a foamed dielectric spacer positioned between the feed network and the ground plane.

7. A layered antenna according to claim 2, including a reflector plane spaced from the rear of the antenna.

8. A layered antenna according to claim 2, wherein the ground plane is formed as a stamped aluminium sheet.

9. A layered antenna according to claim 2, wherein the feed network and the probes are formed as a printed circuit pattern on said insulating substrate.

10. A layered antenna according to claim 2, wherein there is a foamed dielectric sheet spacer positioned between the feed network and the ground plane.

11. A layered antenna having at least one radiating element comprising:

a first metallic ground plane having a pair of identical rectangular apertures in alignment;

a pair of colinear probes each projecting in opposite direction into a respective aperture to form a dipole;

a feed network conductor pattern connected to and arranged to feed the probes in antiphase whereby each probe radiates through its respective aperture; and a second metallic ground plane having a pair of identical rectangular apertures in alignment;

wherein the probes are continuations of the feed network conductor pattern, the feed network conductor pattern and the probes being formed on an insulating substrate adjacent and spaced at a uniform distance to the ground planes;

wherein the dimensions of the apertures and the bounding portions of the ground plane are chosen so that the bounding portions parallel with the probes act as parasitic antenna radiating elements, which together with the pair of radiating probes shape the radiation pattern of the antenna; and wherein the feed network conductor pattern is positioned so as to be in alignment with unapertured portions of the first and second ground planes in a triplate configuration.

12. A layered antenna according to claim 11, having a plurality of radiating elements each according to claim 11, formed as a linear array, the pairs of probes of all the radiating elements being in alignment, the antenna having a feed network conductor pattern arranged to feed all the probes having one orientation in phase and all the probes having an opposing orientation in antiphase.

13. A layered antenna according to claim 11, including a reflector plane spaced from the rear of the antenna.

14. A layered antenna according to claim 11 wherein the ground planes are each formed as a stamped aluminium sheet.

15. A layered antenna according to claim 11, wherein the feed network and the probes are formed as a printed circuit pattern on said insulating substrate.

16. A layered antenna according to claim 11, wherein there is a foamed dielectric sheet positioned between the feed network and a ground plane.

17. A layered antenna according to claim 12, including a reflector plane spaced from the rear of the antenna.

18. A layered antenna according to claim 12, wherein the ground planes are each formed as a stamped aluminium sheet.

19. A layered antenna according to claim 12, wherein the feed network and the probes are formed as a printed circuit pattern on said insulating substrate.

20. A layered antenna according to claim 12, wherein there is a foamed dielectric sheet spacer between the feed network and a ground plane.

* * * * *